US005453765A

United States Patent [19]

Yamaguchi et al.

[11] Patent Number: 5,453,765

[45] Date of Patent: Sep. 26, 1995

[54] THERMALLY REVERSIBLE PRINTING SYSTEM WITH AMBIENT TEMPERATURE COMPENSATION

[75] Inventors: Takashi Yamaguchi; Tadayoshi Ohno; Shinichi Itoh, all of Kawasaki, Japan

[73] Assignee: Kabushiki Kaisha Toshiba, Kawasaki, Japan

[21] Appl. No.: 197,977

[22] Filed: Feb. 17, 1994

[30] Foreign Application Priority Data

Feb. 18, 1993 [JP] Japan ..... 5-029104

[51] Int. Cl.[6] ..... B41J 2/32; B41M 5/26

[52] U.S. Cl. ..... 347/179; 346/135.1; 347/211; 347/224

[58] Field of Search ..... 346/76 PH, 76 R, 346/135.1, 76 L, 108; 400/120; 359/43, 44

[56] References Cited

U.S. PATENT DOCUMENTS

| | | | |
|---|---|---|---|
| 4,696,528 | 9/1987 | Dabisch . | |
| 4,851,924 | 7/1989 | Nakamura et al. | 346/76 PH |
| 5,274,460 | 12/1993 | Yamada et al. | 346/76 L |

FOREIGN PATENT DOCUMENTS

| | | |
|---|---|---|
| 55-154198 | 12/1980 | Japan . |
| 2-19568 | 1/1990 | Japan . |
| 2-3876 | 2/1990 | Japan . |

OTHER PUBLICATIONS

"Proceedings of 4th Japanese Symposium on Non–impact Printing Technologies Symposium", Reversible Thermosensitive Material and Printing Characteristics, pp. 57–60, Jul. 1987, Yoshihiko Hotta & Keish Kubo.

"Japan Hardcopy '90", The Annual Conference of Japan Hardcopy for the Society of Electrophotography of Japan Rewritable Leuco–Thermal Recording Medium, pp. 147–150, Jun. 1990, Yoshihiro Nino & Niro Watanabe.

*Primary Examiner*—Huan H. Tran

[57] ABSTRACT

A printing system for recording and erasing a visible image onto and from a recording medium presenting two states, recording and erasing, by different heating processes, comprises a temperature sensor for sensing ambient temperature, a thermal head, a circuit for computing the temperature difference between a reference ambient temperature and the ambient temperature obtained from the sensor, a circuit for controlling the electrically energizing time of the thermal head in accordance with the temperature difference obtained at the computing circuit, and means for controlling the supply voltage to the thermal head according to the temperature difference. When ambient temperature around the system is lower than the reference ambient temperature, the electrically energizing time of the thermal head is increased. When the ambient temperature is higher than the reference ambient temperature, the supply voltage to the thermal head is decreased. By recording or erasing a visible image in this way, the effect of ambient temperature is corrected, thereby making it possible to always record or erase a visible image onto or from a recording medium stably.

7 Claims, 8 Drawing Sheets

| $\Delta T$ [°C] | $\Delta t_C = f_{C1}(\Delta T)$ [ms] |
|---|---|
| −ε~−10 | 0.10 |
| −10~−15 | 0.21 |
| −15~−20 | 0.31 |
| −20~−25 | 0.42 |
| −25~−30 | 0.52 |

FIG. 7

| $\Delta T$ [°C] | $\Delta V_C = f_{C2}(\Delta T)$ [V] |
|---|---|
| ε~7.5 | 1.0 |
| 7.5~10.0 | 1.5 |
| 10.0~12.5 | 2.0 |
| 12.5~15.0 | 2.5 |

FIG. 8

THERMALLY REVERSIBLE PRINTING SYSTEM WITH AMBIENT TEMPERATURE COMPENSATION

BACKGROUND OF THE INVENTION

1. Field of the Invention

This invention relates to a printing system which records or erases a visible image, with a recording device such as a thermal head, onto or from a recording medium capable of repeated recording or erasing of a visible image by clouding or clarifying the image through the application of thermal energy.

2. Description of the Related Art

Conventional hard copies provide a permanent record of images by externally applying developer (e.g., ink or toner) to a recording medium (e.g., paper) to form an image, or by forming a recording layer on a substrate (e.g., paper) like thermosensitive recording paper and forming a visible image in the recording layer.

As a greater variety of information networks have recently been developed and more and more facsimile machines and copiers are now being used, the consumption of recording mediums has been increasing rapidly, leading to environmental destruction problems including forest destruction and social problems such as waste disposal. To cope with those problems, there is a great demand for the recycling of recording paper and the reduction of recording paper consumption. Therefore, a recording medium allowing repeated recording and erasing has been attracting attention these days.

For recording mediums with such properties, a recording medium has been proposed which changes reversibly from a transparent state to a cloudy state, depending on the temperature applied to the recording medium, as disclosed in Jpn. Pat. Appln. KOKAI Publication No. 55-154198.

For example, when such a recording medium in a cloudy state is heated from room temperature to a first threshold temperature, the medium changes from the cloudy state to a transparent state, and remains transparent even after it has dropped back to room temperature. When the temperature of the recording medium is raised from room temperature through the first threshold temperature to a second threshold temperature, the medium goes into a cloudy state, and remains cloudy even after it has dropped again to room temperature. These changes can be reproduced repeatedly.

A study of degradation of the resolution in repeatedly recording onto such a recording medium with a thermal head, has been reported, for example, in "Proceedings of 4th Japanese Symposium on Non-impact Printing Technologies Symposium," 3-2, p. 57, 1987.

Further, a display changing apparatus has been proposed which records and erases information onto and from a displaying medium having a thermally reversible recording material, as disclosed in, for example, Jpn. UM Appln. KOKAI Publication No. 2-19568. This apparatus contains an erasing device for thermally erasing the records from the displaying medium, and a thermal printing device. This publication discloses an apparatus which erases the thermally reversible display on the floppy disk cartridge with a heater head (the erasing means), and writes the display with a moving thermal head (the printing means).

Further, in Jpn. UM Appln. KOKAI Publication No. 2-3876, another apparatus has been disclosed which records and erases the information onto an information recording card having a thermally reversible recording layer by means of a heat roller (the erasing means) and a thermal head (the printing means).

Still further, in Japan Hardcopy '90, NIP-2, p. 147, 1990, a recording material has been announced which uses leuco dye as a coloring source whose color changes reversibly only under the control of thermal energy.

As mentioned above, a recording method using a recording medium capable of repeated recording and erasing solves the problems encountered with conventional recording methods. As conventionally accomplished, a recording medium made up of a low-molecular/high-molecular composite film alternating between a cloudy and a transparent state, depending on the heating process as mentioned above, is an excellent material which enables a recording and an erasing operation with a thermal head.

In such systems, however, the effect of ambient temperature cannot be ignored. When a visible image is recorded or erased in the open air, there may be a seasonal temperature difference of nearly 30° C.

Therefore, even if a thermal head is simply electrically energized to rise to the clouding temperature or the clarifying temperature, the head cannot be heated to the desired temperature without consideration of the effect of the ambient temperature on the system.

SUMMARY OF THE INVENTION

Accordingly, the object of the present invention is to provide a printing system capable of always recording or erasing a visible image stably, without the adverse effect of ambient temperature, onto or from a recording medium, according to different heating processes.

The foregoing object is accomplished by providing a printing system comprising: temperature sensing section for sensing an ambient temperature around the system; thermal recording section for recording and erasing a visible image by heating the recording medium when supplied with predetermined voltages; comparison section for comparing the ambient temperature sensed by the temperature sensing section with a reference temperature; energizing timing control section for controlling the thermal recording section such that the thermal recording section is electrically energized for a time longer than a reference time, when the comparison section determines that the ambient temperature is lower than the reference temperature, the reference time being a period for which the thermal recording section is electrically energized when the ambient temperature coincides with the reference temperature; voltage control section for controlling the thermal recording section such that a voltage supplied to the thermal recording section is lower than a reference voltage, when the comparison section determines that the ambient temperature is higher than the reference temperature, the reference voltage being a voltage supplied to the thermal recording section when the ambient temperature coincides with the reference temperature.

When the ambient temperature around the system is lower than the reference temperature, the electrically energizing time of the thermal recording means is increased. When the ambient temperature is higher than the reference temperature, the supply voltage to the thermal recording means is decreased. By recording or erasing a visible image in this way, the effect of ambient temperature can be corrected, thereby making it possible to always record or erase a visible image onto or from a recording medium stably.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

FIG. 7 shows a correction table for obtaining a correction value for the thermal-head electrically energizing time;

FIG. 8 shows a correction table for obtaining a correction value for the thermal-head supply voltage;

DETAILED DESCRIPTION OF THE PREFERRED EMBODIMENTS

The present embodiment is characterized in that the effect of ambient temperature is corrected by decreasing the thermal head supply voltage when the ambient temperature is higher than the reference temperature and by increasing the thermal head electrically energizing time when the ambient temperature is lower than the reference temperature.

Figure 9:
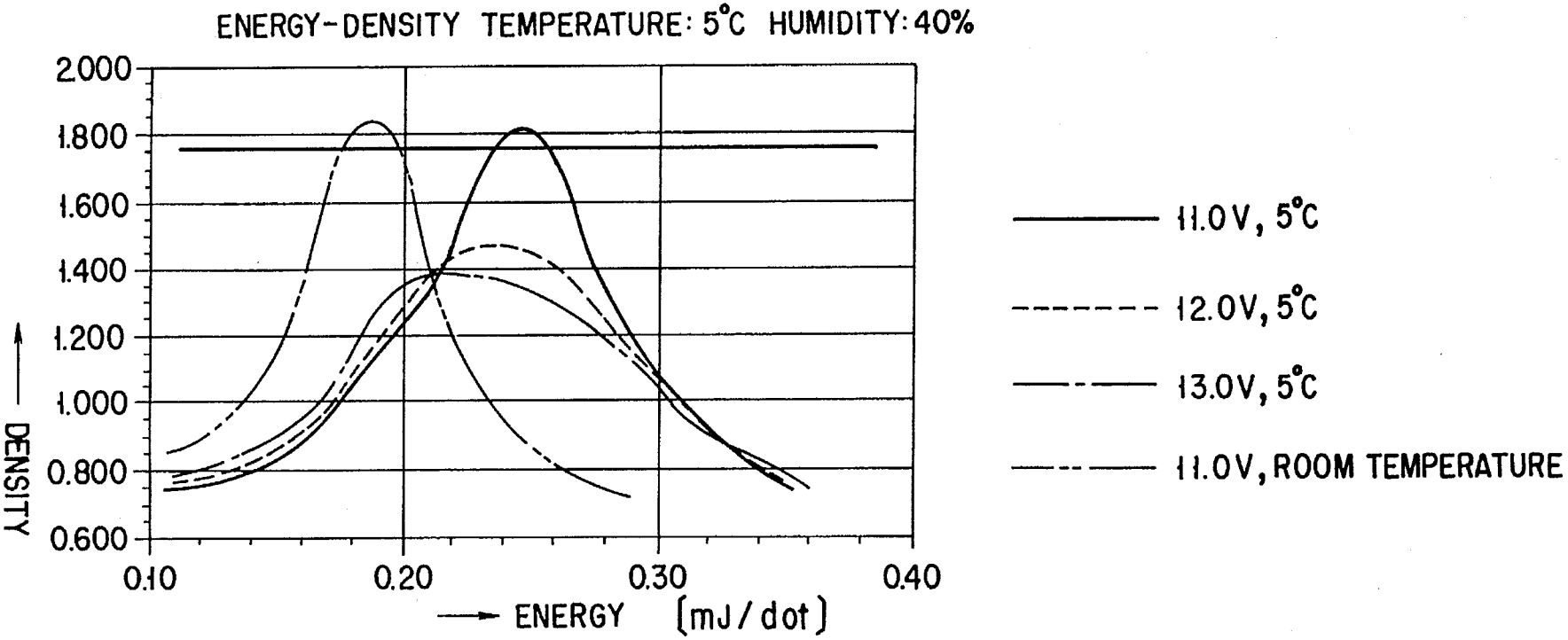
FIG. 9 is a characteristic diagram of the relationship between energy and image density when the supply voltage at an ambient temperature of 5° C. is used as a parameter.
Figure 10:
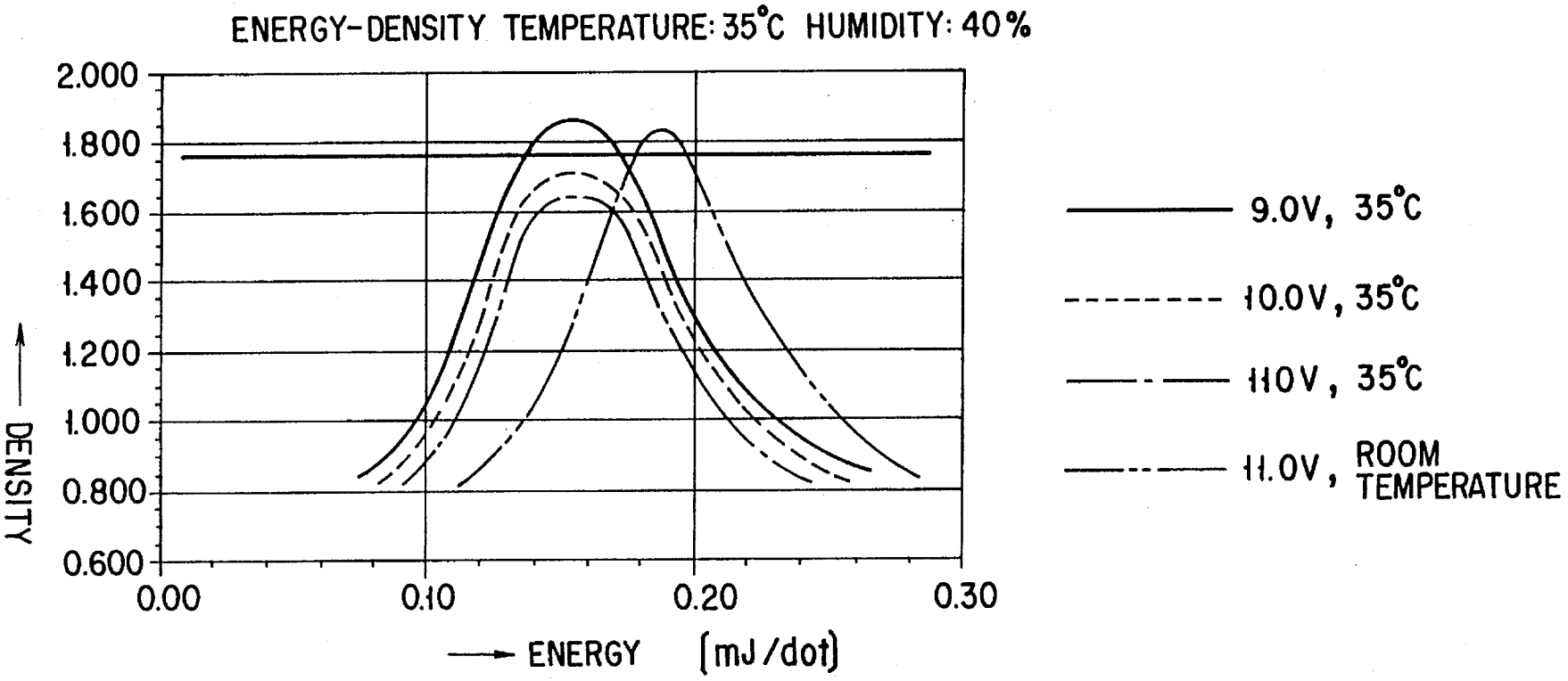
FIG. 10 is a characteristic diagram of the relationship between energy and image density when the supply voltage at an ambient temperature of 35° C. is used as a parameter.

A reason for making corrections as explained above will be described below. FIGS. 9 and 10 show the results of experimentally measuring the relationship between energy and image density by using various supply voltages at an ambient temperature of 5° C. and of 35° C.

Two characteristics were experimentally measured for ambient temperatures of 5° C. and 35° C. including clouding characteristic curves (from the original color to cloudiness) and clarifying characteristic curves (from the original color through cloudiness to transparency). Since the clarifying characteristic curves present their features more noticeably, only they are shown. In both FIGS. 9 and 10, energy is controlled by electrically energizing time modulation. Note that, when energy is the same, the higher the supply voltage, the shorter the electrically energizing time. In the figures, the bold horizontal lines near a density of 1.8 indicate the density of the original color. As the curve approaches the horizontal line in the figures, erasability is improved.

First, in the graph FIG. 9 with an ambient temperature of 5° C., a comparison of the data at room temperature (27° C.) with a voltage of 11.0 V with the data at 5° C. with a voltage of 11.0 V shows that there is a difference of nearly 0.08 mJ between the peak positions, although both peak values coincide at nearly 1.8. This means that when the supplied energy is controlled by electrically energizing time modulation, the same erasing density peak value as that at room temperature can be obtained even at an ambient temperature of 5° C., by making the electrically energizing time longer than that at room temperature to increase the energy by nearly 0.08 mJ.

A comparison of the data items at 5° C. with voltages of 11.0 V, 12.0 V, and 13.0 V shows that as the applied voltage increases, the density peak value decreases accordingly, resulting in the poorer erasability. Therefore, at an ambient temperature of 5° C., by keeping the supply voltage at the same level as that at room temperature, and increasing the electrically energizing time, it is possible to cope with changes in the surrounding conditions with the erasability remaining unchanged.

Further, in the graph of FIG. 10 for an ambient temperature of 35° C., a comparison of the data at room temperature with a voltage of 11.0 V, and the data at 35° C. with a voltage of 11.0 V, 10.0 V and 9.0 V shows that although erasing can be performed as far as the original color at room temperature with a voltage of 11.0 V, the peak value of the density curve decreases by nearly 0.2 at 35° C. with a voltage of 11.0 V, degrading the erasability. However, even at a temperature of 35° C., as the supply voltage is decreased from 11.0 V to 10.0 V and to 9.0 V, the peak value of the density curve becomes higher. This, at 9.0 V, the same density as that at room temperature can be obtained. Therefore, at an ambient temperature of 35° C., by decreasing the supply voltage, the erasability can be maintained even if the ambient temperature changes. While in the present embodiment, temperature data, at ambient temperatures of 5° C. and 35° C. are shown, similar results were obtained at other low ambient temperatures.

Hereinafter, an embodiment of the present invention will be explained in detail with reference to the accompanying drawings.

Figure 1:
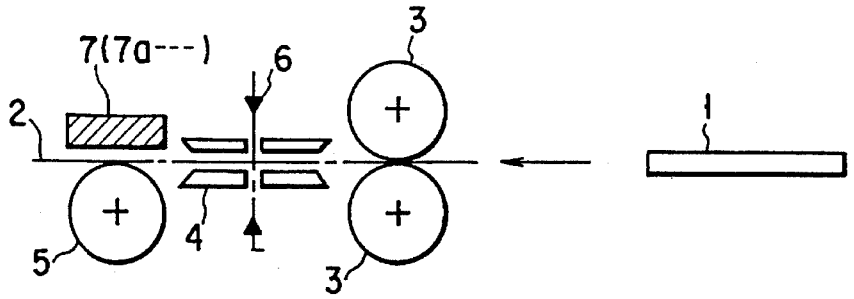
FIG. 1 is a schematic diagram of a recording apparatus using a printing system of the present invention.

FIG. 1 shows an embodiment of a recording apparatus using a printing system of the present invention. A recording medium 1 is conveyed along a transport path 2, passing through a pair of transport rollers 3, a transport guide 4, and a platen roller 5 in that order. Provided near the transport guide 4 on the transport path 2 is a position sensor which senses the leading edge of the recording medium 1 carried along the path 2. The position sensor 6 is a known sensor composed of a pair of a light-emitting element and a light-receiving element. The transport roller pair 3 is rotated by a motor (not shown). Opposite the platen roller 5, a thermal head 7 composed of heating elements *7a* . . . , which are linearly arranged, is provided. This thermal head 7 is fixed to the recording apparatus body.

Figure 2:
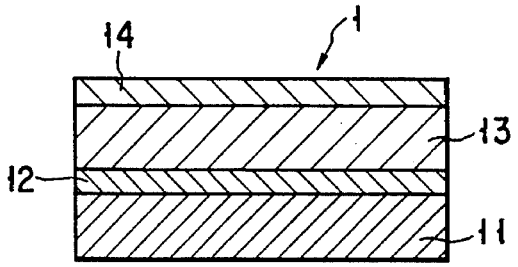
FIG. 2 is a sectional view of a recording medium.

The recording medium 1 uses a low-molecular and high-molecular composite recording film as a recording layer. The recording medium 1 changes its state from transparent to cloudy or vice versa, depending on the heating temperature. This change is reversible. Controlling the heating temperature enables the medium to alternate between a transparent state and a cloudy state repeatedly. FIG. 2 is a sectional view of the recording medium 1. Specifically. the recording medium 1 is composed of: a colored layer 12 (e.g., colored black); a recording layer 13 which changes reversibly from a transparent state to a cloudy state; and a protective layer 14, each laminated on top of another in that order on one surface of a substrate 11.

Figure 3:
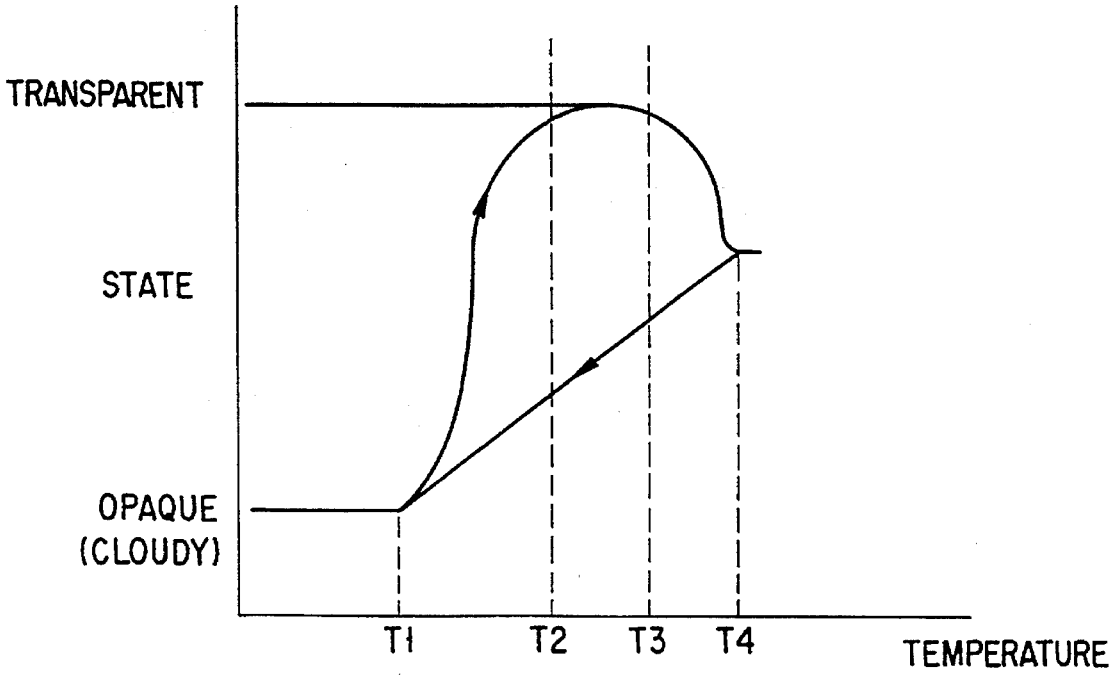
FIG. 3 shows a temperature characteristic of the recording medium.

The temperature characteristic of the recording medium 1 is shown in FIG. 3. When the recording medium 1 of a cloudy state at room temperature (T1) is heated to temperature T2, the medium 1 changes to a transparent state and remains transparent even after it is cooled down to room temperature T1. Next, when the recording medium 1 of the transparent state at room temperature (T1) is heated through temperature T2 and T3 to temperature T4, and then is cooled down to T1 again, the medium 1 turns to a cloudy state and remains cloudy. As mentioned above, this change can be reproduced repeatedly.

Figure 4:
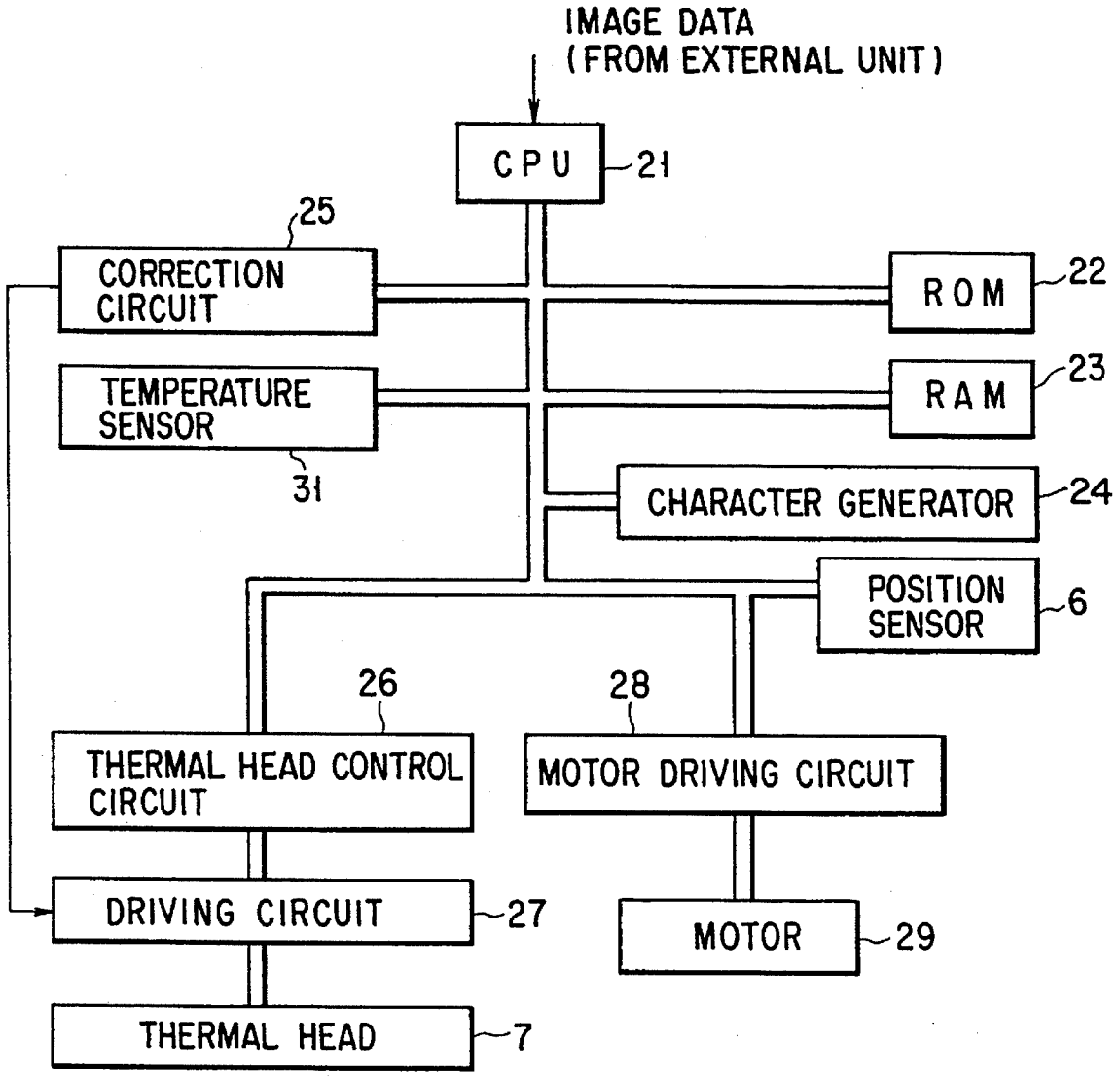
FIG. 4 is a schematic block diagram of a recording apparatus using a printing system of the present invention.

FIG. 4 is a schematic block diagram of the electric circuit of a recording apparatus according to the present invention. Connected to a CPU (central processing unit) 21 are a ROM (read only memory) 22, a RAM (random access memory) 23, a character generator 24, a correction circuit 25, a thermal head control circuit 26, a motor driving circuit 28. a position sensor 6, and a temperature sensor 31.

The ROM 22 stores a control program of the CPU $et_c$. The RAM 23 is used to temporarily store various types of data including the bit data from the character generator 24. The CPU 21 takes in code data as image data from an external unit (not shown) and supplies the code data to the character generator 24. The character generator 24, which stores font data items (i.e., bit data items) corresponding to various character code data items, and generates a bit data item corresponding to the code data item. The bit data is transferred to the correction circuit 25. The temperature sensor 31 senses the temperature around a place where the present recording apparatus is installed.

Figure 11A:
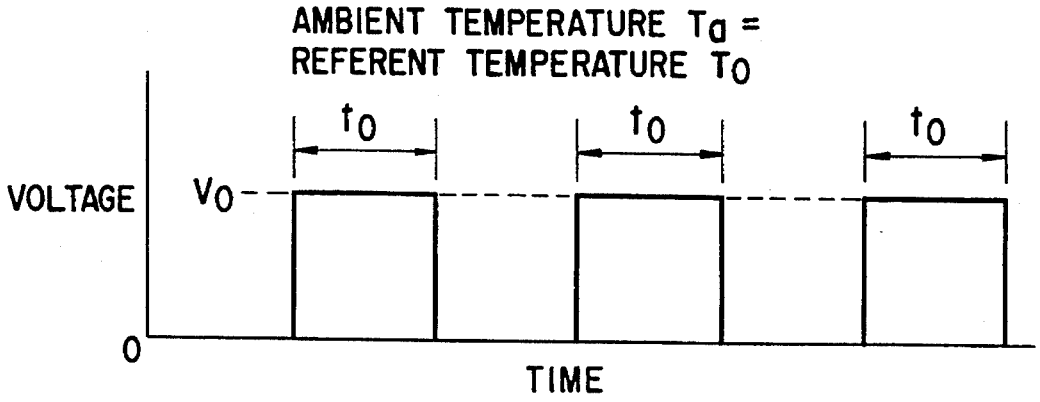
FIGS. 11A–11C show supply voltages and electrically energizing times of the thermal-head, relative to the ambient temperature.
Figure 11B:
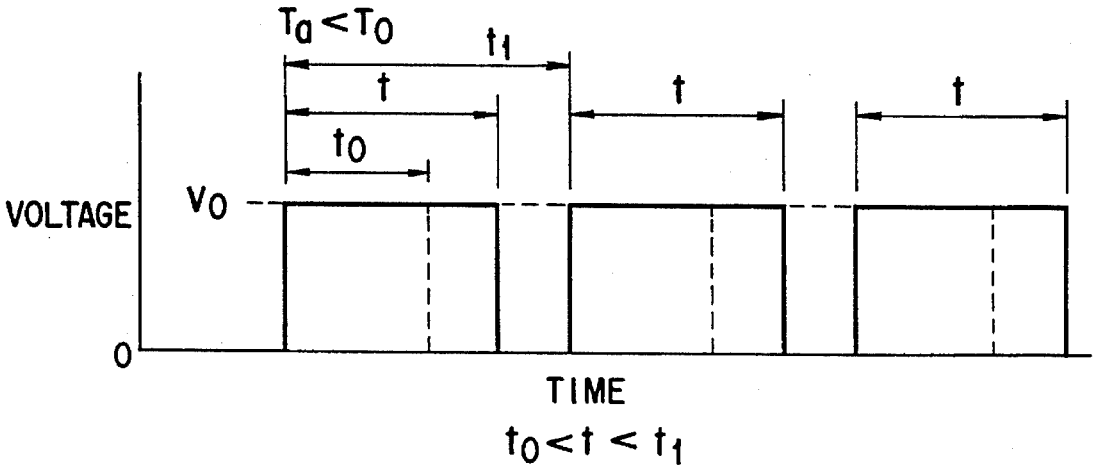
Figure 11C:
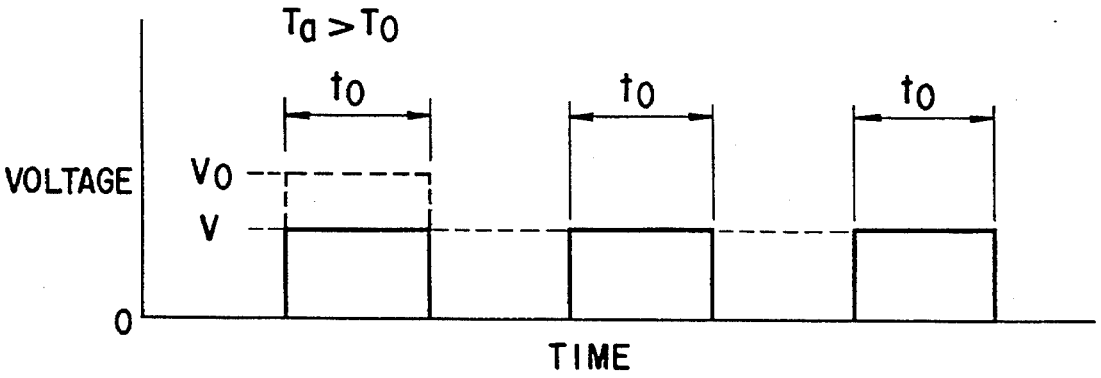

The correction circuit 25 takes in the ambient temperature from the temperature sensor 31 and corrects the electrically energizing time or the supply voltage of each heating element *7a*, . . . for forming a dot. FIGS. 11A–11C show supply voltages V and electrically energizing times t of the heating element *7a* of the thermal head 7, when visible pixels are continuously recorded. When the ambient temperature $T_a$ is equal to predetermined reference temperature $T_0$ (FIG. 11A), supply voltage V is $V_0$ and the electrically energizing time t is $t_0$. When the ambient temperature $T_a$ is lower than the reference temperature $T_0$ (FIG. 11B), the electrically energizing time t is increased, still the supply voltage V is $V_0$. In this case, the electrically energizing time t must be smaller than a time $t_1$ which required for the thermal head to record (or scan) one line. Therefore, the electrically energizing time t is: $t_0<t<t_1$. When the ambient temperature $T_a$ is higher than the reference temperature $T_0$ (FIG. 11C), the supply voltage V is decreased, still the electrically energizing time t is $t_0$. The correction circuit 25 may be realized in program form by using the ROM 22 or the RAM 23. The corrected bit data is transferred to the thermal head control circuit 26.

The motor driving circuit 28 actuates a motor 29 that rotates the transport roller pair 3, thereby conveying the recording medium 1. After the sensor 6 has sensed the leading edge of the recording medium 1, the thermal head control circuit 26 intermittently applies electric pulses corresponding to the corrected bit data to the individual heating elements *7a* . . . of the thermal head 7 with a specified timing. As a result, the heating elements *7a*, . . . are heated corresponding to the bit data to form an image in the recording layer 13 or to erase (clarify) the unnecessary visible image from the recording layer 13.

Figure 5:
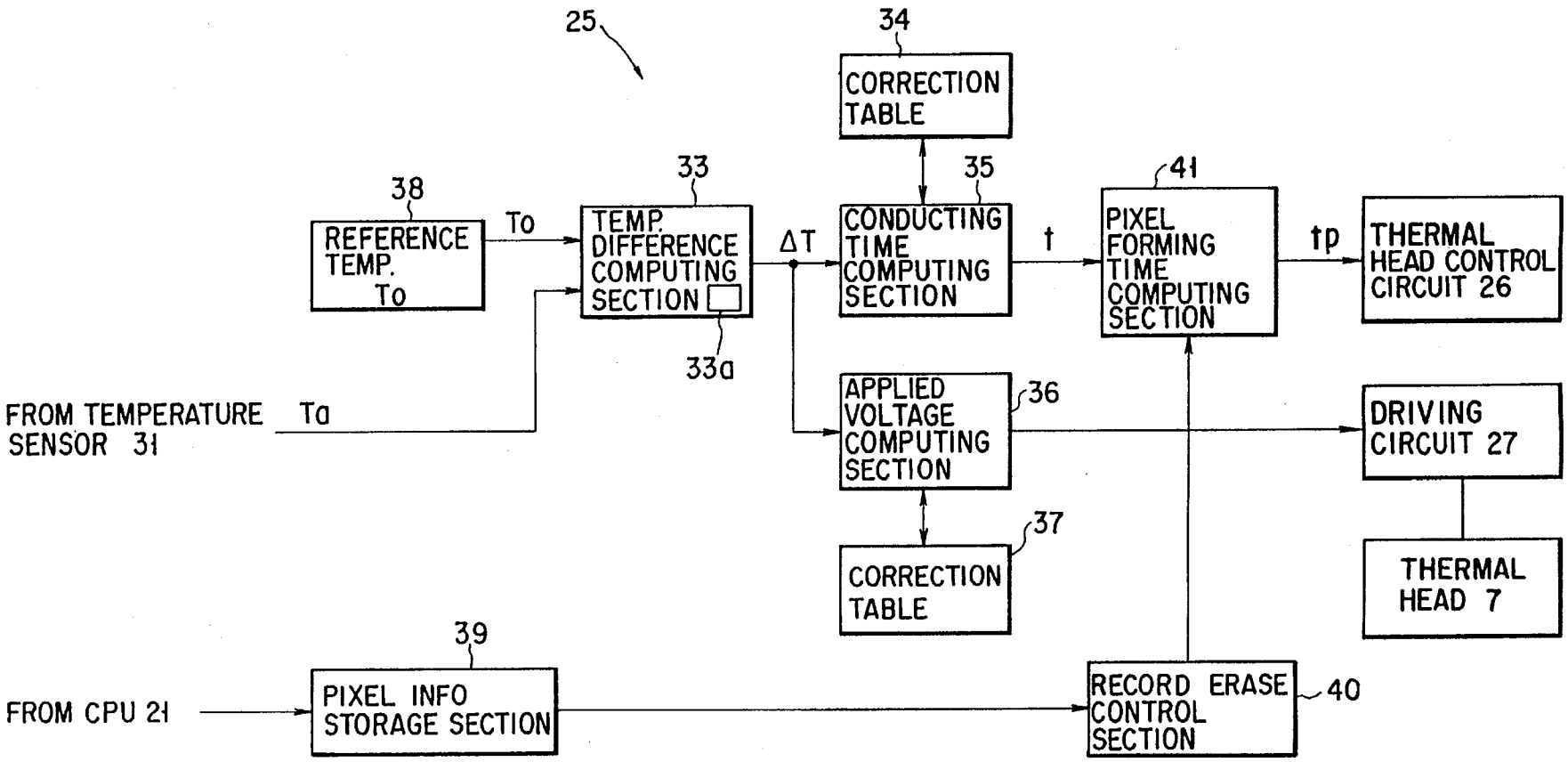
FIG. 5 is a block diagram of the correction circuit of FIG. 4.

FIG. 5 is a block diagram of the correction circuit 25 of FIG. 4. A reference temperature table 38 has stored a reference ambient temperature $T_o$ previously. A temperature difference computing section 33 compares the ambient temperature $T_a$ sensed at the ambient temperature sensor 31 with the reference temperature $T_o$ from the reference temperature table 38 with a comparator 33*a* and obtains the temperature difference ΔT between the ambient temperature $T_a$ and the reference temperature $T_o$.

A electrically energizing time computing section 35 compares the temperature difference ΔT obtained at the temperature difference computing section 33 with a reference temperature allowance of ϵ and calculates the electrically energizing time of the thermal head, explained later, by comparing the comparison result with the data stored in the correction table 34. Similarly, a supply voltage computing section 36 compares the temperature difference ΔT obtained at the temperature difference computing section 33 with the reference temperature allowance ϵ and calculates the supply voltage to the thermal head, explained later, by comparing the comparison result with the data stored in the correction table 37.

A pixel information storage section 39 is an image memory in which the bit data transferred from the character generator 24 via the CPU 21 is stored. A record/erase control section 40 reads the bit data items sequentially from the pixel information storage section 39, judges whether each bit data item is of a recording bit or an erasing bit, that is, judges the operation mode of each bit, and supplied the operation mode to a pixel forming time computing section 41. The pixel forming time computing section 41 determines the pixel forming time $t_p$ of each bit, depending on whether the operation mode set at the record/erase control section 40 is the recording or the erasing mode.

The pixel forming time $t_p$ is transferred to the thermal head control circuit 26 of FIG. 4, and the pulses corresponding to the pixel forming time $t_p$ are supplied to the thermal head driving circuit 27. The thermal head driving circuit 27 actuates the heating element *7a* of the thermal head 7 by using the pulses. In this way, by selectively applying the recording/erasing energy proportional to the pixel forming time $t_p$ obtained at the pixel forming time computing section 8, to the recording medium 10 by means of the thermal head, the recording/erasing of a visible image is effected.

Figure 6:
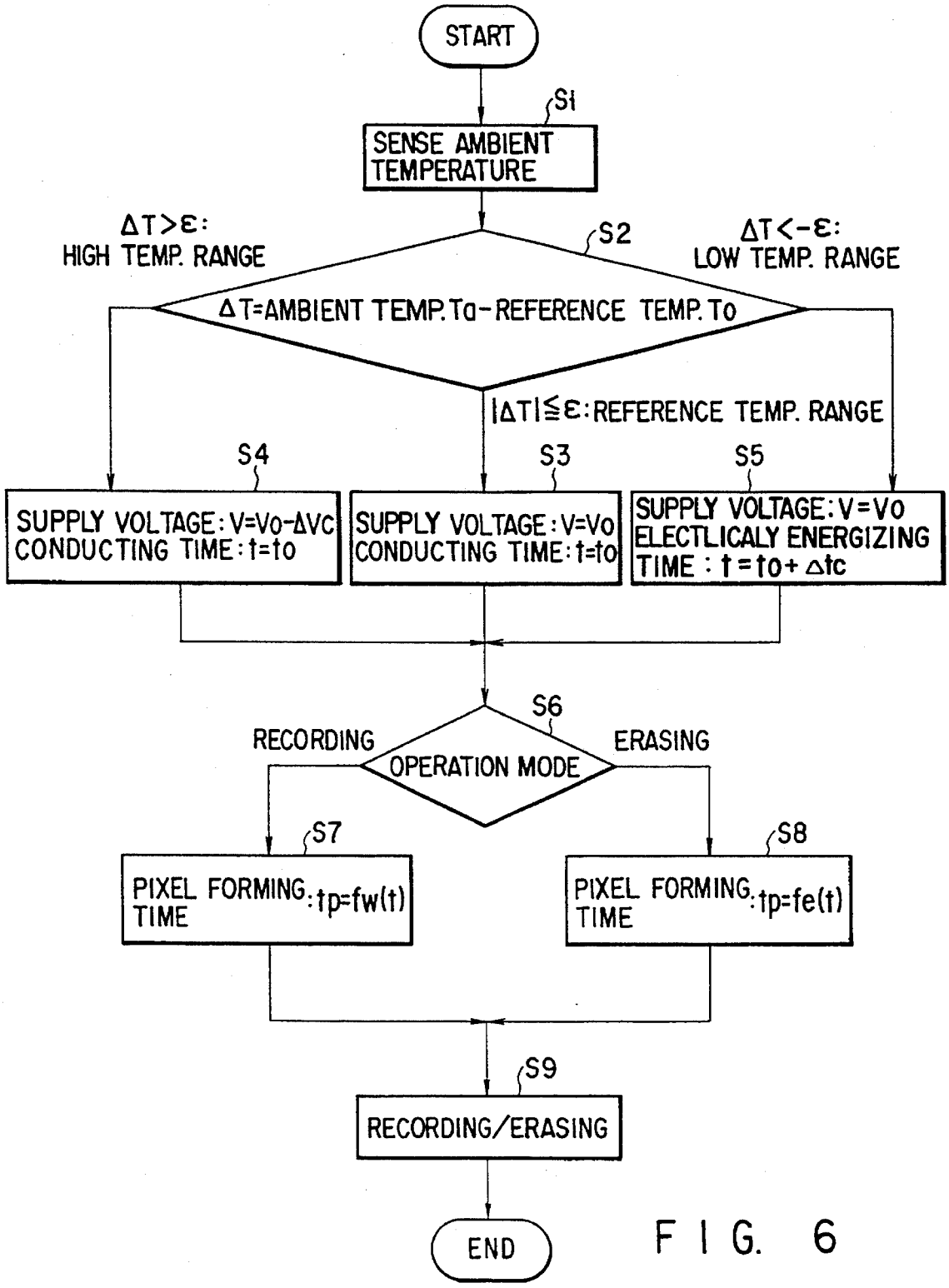
FIG. 6 is a flowchart for explaining how a visible image is recorded and erased.

A recording/erasing operation of a visible image in the above-described construction will be explained with reference to the flowchart of FIG. 6.

First, the ambient sensor 31 senses ambient temperature $T_a$ (S1). Then, the temperature difference computing section 33 obtains the temperature difference ΔT between the sensed ambient temperature $T_a$ and the reference temperature $T_o$ from the reference temperature table 38 (S2).

$$\Delta T=T_a-T_o$$

The temperature difference computing section 33 supplies this temperature difference ΔT to the electrically energizing time computing section 35 and the supply voltage computing section 36.

The electrically energizing time computing section 35 and the supply voltage computing section 36 compare the temperature difference ΔT with the specified temperature allowance ϵ (e.g., five degrees), referring to the correction table 34 and the correction table 37, respectively. As a result, the operation goes to one of the following three branches:

(1) When $|\Delta T|\leqq\epsilon(T_o-\epsilon\leqq T_a\leqq T_o+\epsilon)$

The supply voltage computing section 36 supplies $V_o$ as thermal-head supply voltage V to the thermal head driving circuit 27. The electrically energizing time computing section 35 supplies $t_o$ as electrically energizing time t to the pixel forming time computing section (S3).

(2) When $\Delta T>\epsilon(T_o+\epsilon<T_a)$

The supply voltage computing section 36 supplies $V_o-\Delta V_c$ as thermal-head supply voltage V to the thermal head driving circuit 27. The electrically energizing time computing section 35 supplies $t_o$ as electrically energizing time t to the pixel forming time computing section (S4).

(3) When $\Delta T<-\epsilon(Ta<T_o-\epsilon)$

The supply voltage computing section 36 supplies $V_o$ as thermal-head supply voltage V to the thermal head driving circuit 27. The electrically energizing time computing section 35 supplies $t_o+\Delta T_c$ as electrically energizing time t to the pixel forming time computing section (S5).

where $\epsilon$: reference temperature allowance ($\epsilon\geqq 0$)

V: thermal-head supply voltage $V_o$: thermal-head reference supply voltage $\Delta Vc$: thermal-head corrected supply voltage=$f_{c2}$ ($\Delta T$) ($\Delta Vc\geqq 0$)

$t_o$: thermal-head reference electrically energizing time $\Delta t_c$: thermal-head corrected electrically energizing time= $f_{c1}$ ($\Delta T$) ($\Delta tc\geqq 0$)

As described above, when ($T_o\epsilon\leqq T_a\leqq T_o+\epsilon$), the thermal-head supply voltage V and the thermal-head electrically energizing time t are set at the values at the reference temperature, respectively. When ($T_o+\epsilon<T_a$), the thermal-head supply voltage V is set at thermal-head reference supply voltage $V_o$ minus correction value $\Delta V_c$, and the thermal-head electrically energizing time t is set at thermal-head reference electrically energizing time $t_o$. When ($T_a<T_o-\epsilon$), the thermal-head supply voltage V is set at thermal-head reference supply voltage $V_o$, and the thermal-head electrically energizing time t is set at thermal-head reference electrically energizing time $t_o$ plus correction value $\Delta t_c$. These correction values are determined by referring to the correction table 34 and 37 storing the correction data corresponding to the difference between ambient temperature $T_a$ and reference temperature $T_o$. As an alternative to this embodiment, the electrically energizing time ($t_o+\Delta t_c$) or the supply voltage ($V_o-\Delta V_c$) corresponding to the temperature difference $\Delta T$ supplied from the temperature difference computing section 33 may be stored in the correction tables 34 and 37, respectively. In this case, the data items stored in the correction tables 34 and 37 can be directly transferred to the thermal head control circuit 26 or the driving circuit 27.

Next, the operation of the pixel forming time computing section 41 goes to one of two branches, depending on whether the recording or the erasing mode is on (S6). In each mode, the pixel forming time $t_p$ is determined. At this time, the record/erase control section 40 supplies a recording or an erasing signal to the pixel forming time computing section 41 on the basis of each pixel information item from the pixel information storage section 39.

The pixel forming time $t_p$ is expressed as a function of electrically energizing time t:

In the recording mode (S7), $$t_p=f_w(t)$$

In the erasing mode (S8), $$t_p=f_e(t)$$

For the sake of simplicity, in this embodiment, it is assumed that:

During a recording operation: $t_p=t$

During an erasing operation: $t_p=t/2$

Using the values set as described above, the thermal head control circuit 26 powers the thermal head 7 via the thermal head driving circuit 27. As a result, a visible image is recorded or erased onto or from the recording medium 1 (S9).

For example, when ambient temperature is 5° C., under the following conditions:

Ambient temperature: $T_a$=5° C.

Reference temperature: $t_o$=25° C.

Reference temperature allowance ($\epsilon\geqq 0$): $\epsilon$=5° C.

Thermal-head reference electrically energizing time: $t_o$=1.8 ms the following equation is given;

$$\Delta T=T_a-To=-20°\ C.$$

Thus, condition (1) of $|\Delta T|\leqq\epsilon(=5)$ is not met, condition (2) of $\Delta T(=-20)>\epsilon(=5)$ is not met, and condition (3) of $\Delta T(=-20)<-\epsilon(=-5)$ is met.

Therefore, the thermal head electrically energizing time amounts to the thermal head electrically energizing time at the reference temperature plus correction value $\Delta t_c$. An example of the correction table 34 used to obtain the correction value $\Delta t_c$ of the electrically energizing time is shown in FIG. 7. As seen from FIG. 7, because $\Delta t_c$=0.42 ms, the electrically energizing time t of the thermal head is:

$$t=t_o+\Delta t_c=1.8+0.42=2.22\ ms$$

Thus, during recording, the pixel forming time $t_p$ is:

$$t_p=t=.22\ ms$$

During erasing, it is:

$$t_p=t/2=1.11\ ms$$

Further, for example, when ambient temperature $T_a$ is 35° C., under the following conditions:

Ambient temperature: $T_a$=35° C.

Reference temperature: $t_o$=25° C.

Reference temperature allowance ($\epsilon\geqq 0$): $\epsilon$=5° C.

Thermal-head reference electrically energizing time: $t_o$=1.8 ms the following equation is given;

$$\Delta T=T_a-T_o=10°\ C.$$

Thus, condition (1) of $|\Delta T(=10)|\leqq\epsilon(=5)$ is not met, condition (2) of $\Delta T(=10)>\epsilon(=5)$ is met, and condition (3) of $\Delta T(=10)<-\epsilon(=-5)$ is not met.

Therefore, the thermal head supply voltage amounts to the thermal head supply voltage at the reference temperature minus correction value $\Delta V_c$. The time during which the thermal head is electrically energized is set at the electrically energizing time at the reference temperature. An example of the correction table 37 used to obtain the correction value $\Delta V_c$ of the applied voltage is shown in FIG. 8. As seen from FIG. 8, because $\Delta V_c$=2.0 V, the thermal head applied volt age V is:

$V=V_o-\Delta V_c=11.0-2.0=9.0$ (volt)

Because the thermal head electrically energizing time is not corrected and set at the value at the reference temperature, this gives:

t=1.8 ms

Thus, during recording, the pixel forming time $t_p$ is:

$t_p$=t=1.8 ms

During erasing, it is:

$t_p$=t/2=0.9 ms

As has been described above in detail, with the present invention, it is possible to provide a printing system capable of always recording or erasing a visible image stably onto a recording medium independently of ambient temperature.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A printing system for recording a visible image on a recording medium by heating the recording medium to a predetermined temperature, and for erasing a visible image from the recording medium by heating the recording medium to another temperature, said system comprising:

temperature sensing means for sensing an ambient temperature around said system;

thermal recording means for recording and erasing a visible image by heating the recording medium;

comparison means for comparing said ambient temperature sensed by said temperature sensing means with a reference temperature and providing a temperature difference thereof;

storing means for storing a plurality of electrically energizing periods of time for said thermal recording means and a plurality of supply voltages to be supplied to said thermal recording means, which respectively correspond to said temperature differences between various values of said ambient temperature and said reference temperature;

energizing timing control means for controlling said electrically energizing periods of time by reading out from said storing means a suitable one of said electrically energizing periods of time corresponding to said temperature difference so as to output said suitable one of said electrically energizing periods of time, when said temperature sensing means determines that said ambient temperature is lower than said reference temperature; and voltage control means for controlling a voltage by reading out from said storing means a suitable one of said supply voltages corresponding to said temperature difference so as to output said suitable one of said supply voltages, when said temperature sensing means determines that said ambient temperature is higher than said reference temperature.

2. A system according to claim 1, wherein said voltage control means includes means for supplying said reference voltage to said thermal recording means when said comparison means determines that said ambient temperature is lower than said reference temperature.

3. A system according to claim 1, wherein said energizing timing control means includes means for supplying said reference time to said thermal recording means when said comparison means determines that said ambient temperature is higher than said reference temperature.

4. A system according to claim 1, wherein said reference temperature is a temperature within a predetermined temperature range.

5. A system according to claim 1, wherein:

said comparison means contains means for storing a value of said reference temperature and for comparing said ambient temperature sensed by said temperature sensing means with said reference temperature to provide a temperature difference;

said electrically energizing time control means contains means for inputting said temperature difference from said comparison means, first storage means for storing an electrically energizing time correction value corresponding to said temperature difference, and means for, when said temperature is lower than said reference ambient temperature, outputting to said thermal recording means an electrically energizing time obtained by adding said electrically energizing time correction value obtained from said first storage means to said reference time used when said ambient temperature is equal to said reference temperature; and said supply voltage control means contains means for inputting said temperature difference from said comparison means, second storage means for storing a supply voltage correction value corresponding to said temperature difference, and means for, when said ambient temperature is higher than said reference temperature, outputting to said thermal recording means a supply voltage obtained by substracting said supply voltage correction value obtained from said second storage means from said reference voltage used when said ambient temperature is equal to said reference temperature.

6. A printing system for recording visible images on a recording medium by heating said recording medium to a first temperature, and erasing said visible image from said recording medium by heating said recording medium to a second temperature different from said first temperature, comprising:

thermal recording means for recording and erasing a visible image onto and from a recording medium by heating selectively said recording medium to said first and second temperature;

temperature sensing means for sensing ambient temperature around said system;

first storing means for storing image data composed of visible pixels and erasing pixels, said visible pixels being recorded onto said recording medium by heating said medium to said first temperature, and said erasing pixels being recorded on said medium by heating said recording medium to said second temperature consequently to erase said visible pixels recorded on said medium;

judging means for reading each of said pixels stored in said first storing means, judging whether each of said pixels is one of said visible pixels or one of said erasing pixels, and providing a judgment;

comparison means for comparing said ambient temperature sensed by said temperature sensing means with a reference temperature and providing a temperature difference thereof;

second storing means for storing a plurality of electrically energizing periods of time for said thermal recording means and a plurality of supply voltages to be supplied to said thermal recording means, which respectively correspond to said temperature differences between various values of said ambient temperature and said reference temperature;

electrically energizing time control means for controlling said electrically energizing periods of time of said thermal recording means by reading out from said second storing means a suitable one of said electrically energizing periods of time corresponding to said temperature difference so as to output said suitable one of said electrically energizing periods of time, when said comparison means determine that said ambient temperature is lower than said predetermined reference temperature;

converting means for converting said suitable one of said electrically energizing periods of time controlled by said electrically energizing time control means to an electrically energizing time for recording visible pixel and for erasing visible pixel corresponding to the data from said first storing means, based on said judgment from said judging means;

voltage control means for controlling a voltage of said thermal recording means by reading out from said second storing means a suitable one of said supply voltages corresponding to said temperature difference so as to output said suitable one of said supply voltages, when said comparison means determines that said ambient temperature is higher than said reference temperature; and means for outputting said suitable one of said electrically energizing periods of time converted by said converting means and said suitable supply voltage controlled by said supply voltage control means to said thermal recording means.

7. A printing system for recording an image on a recording medium by heating the recording medium and for erasing the image recorded on the recording medium by heating the recording medium, said printing system comprising:

a thermal recording head for heating the recording medium so as to record the image on the recording medium and erase the image recorded on the recording medium;

means for supplying a first voltage to the thermal recording medium;

means for electrically energizing the thermal recording head for a first time period;

means for sensing an ambient temperature around the thermal recording head;

means for comparing the ambient temperature sensed by the sensing means with a reference temperature;

first changing means for changing the voltage supplied from the supplying means so as to supply a second voltage lower than the first voltage to the thermal recording head when the sensed ambient temperature is higher than the reference temperature; and second changing means for changing the electrically energizing time used for the energizing means so as to electrically energize the thermal recording head for a second time period longer than the first time period when the sensed ambient temperature is lower than the reference temperature.

* * * * *